United States Patent [19]

Fujita et al.

[11] 3,947,789

[45] Mar. 30, 1976

[54] MOTOR TIMER

[75] Inventors: Teizo Fujita; Tosiro Ohashi; Toyohiko Chiba, all of Osaka, Japan

[73] Assignee: Izumi Denki Company Limited, Osaka, Japan

[22] Filed: Nov. 11, 1974

[21] Appl. No.: 522,833

[30] Foreign Application Priority Data

Nov. 14, 1973 Japan ..... 48-128083
Nov. 14, 1973 Japan ..... 48-128084
Nov. 14, 1973 Japan ..... 48-128085

[52] U.S. Cl. ..... 335/74; 200/38 R; 335/75
[51] Int. Cl.[2] ..... H01H 43/02
[58] Field of Search ..... 335/75, 74, 68, 69, 70, 335/71, 72, 73, 65; 200/38, 39

[56] References Cited

UNITED STATES PATENTS

| | | | |
|---|---|---|---|
| 3,665,348 | 5/1972 | Haydon | 200/38 R |
| 3,725,616 | 4/1973 | Pearson | 335/74 |
| 3,774,127 | 11/1973 | Ohashi | 335/74 |
| 3,810,050 | 5/1974 | Pearson | 335/75 |

*Primary Examiner*—Harold Broome
*Attorney, Agent, or Firm*—Elliott I. Pollock

[57] ABSTRACT

A motor timer comprises a prefabricated timing mechanism block including a drive motor, a reduction gear, a clutch and a timing gear; a prefabricated contact mechanism block including a leaf-spring contact assembly and an actuating member for actuating the leaf spring contact interconnecting; and means for assemblying the blocks at a final stage of assembly.

15 Claims, 6 Drawing Figures

MOTOR TIMER

The present invention relates to a motor timer, or more in particular to a small compact motor timer.

In the conventional motor timer, unit component elements such as a reduction gear, a clutch, a contact mechanism or an electromagnetic device are arranged in such a complicated manner that it is difficult to introduce a belt production system for mass-production in which a plurality of prefabricated blocks of component elements are assembled at the final production step. Further, variations in quality of the component elements are cumulatively reflected in the finished product as a whole.

An object of the present invention is to provide a motor timer which has obviated the above-mentioned disadvantages.

Another object of the invention is to provide a motor timer which comprises a separately prefabricated gear mechanism unit including a drive motor, a clutch system, and a reduction gear on the one hand; and an electromagnetic relay including a contact mechanism and an electromagnetic device having an electromagnetic coil and an armature, the contact mechanism being mounted on one side of the electromagnetic device; so that the assembly job is completed only by mounting the electromagnetic relay on the underside of the gear mechanism unit.

Still another object of the invention is to provide a motor timer which comprises: a gear mechanism block including drive motor, a clutch, and a reduction and other gears; and a contact mechanism block including a leaf-spring contact assembly integrated with a cam device for energizing the leaf-spring contact assembly, the contact mechanism block being mounted on one side of the electromagnetic device block; so that the above-described three blocks prefabricated in separate steps are easily assembled by means of screws or the like.

A further object of the invention is to provide a motor timer in which the direction of operation of the contacts is at right angles to the direction of operation of the electromagnetic device so as to prevent the attraction and repulsion of the electromagnetic device from influencing the operation of the contacts.

The above and other objects, features and advantages will be made apparent by the detailed description taken in conjunction with the accompanying drawings, in which.

Figure 1:
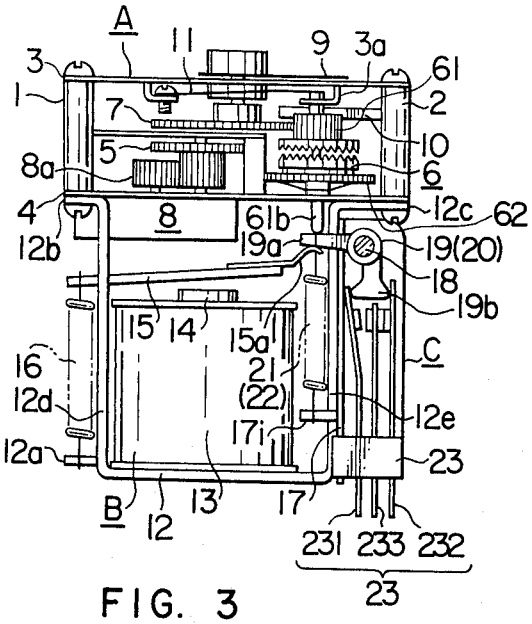
FIG. 1 is a front view of a motor timer showing an embodiment of the present invention.
Figure 2:
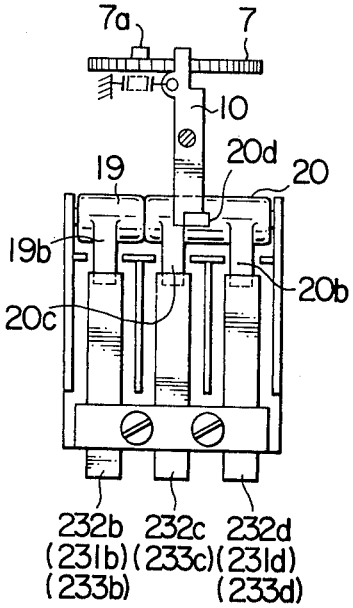
FIG. 2 is a side view showing a part of the motor timer of FIG. 1.
Figure 3:
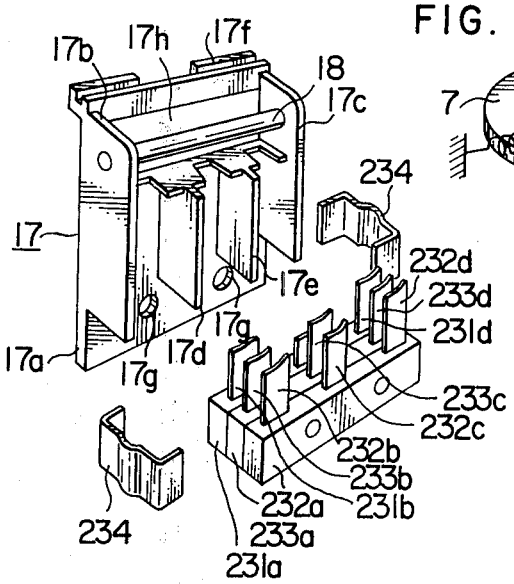
FIG. 3 is a disassembled perspective view showing the contact mechanism block of the motor timer of FIG. 1.
Figure 4:
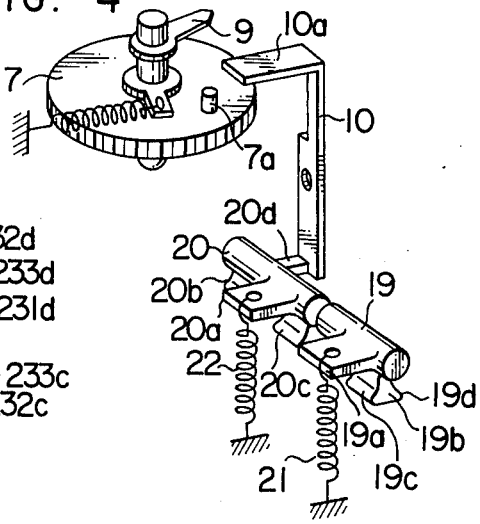
FIG. 4 is a perspective view showing the manner in which the timing operation cam is engaged.
Figure 5:
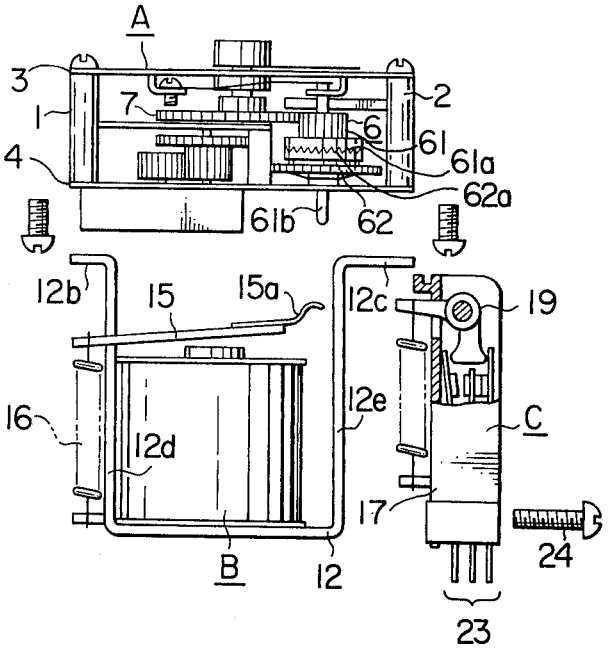
FIG. 5 is a disassembled front view showing each block making up the motor timer of FIG. 1.
Figure 6:
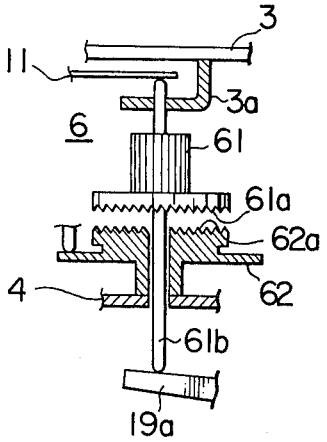
FIG. 6 is a partial sectional view showing the clutch mechanism.

The invention will be now described in detail with reference to embodiments shown in the accompanying drawings.

Reference symbol A shows a timing operation gear mechanism block containing a pair of support plates 3 and 4 supported by support members 1 and 2. A reduction gear 5, a clutch mechanism 6 and an indication or timing gear 7 are held between the support plates 3 and 4. Reference numeral 8 identifies a drive motor mounted on the underside of the lower support plate 4. The bearing shaft of the indication or timing gear 7 is projected upwardly from the upper support plate 3, and a pointer 9 is attached to the projecting portion of the bearing shaft and rotates with the indication or timing gear 7.

A protrusion 7a is formed at a certain portion on the upper surface of the indication or timing gear 7, so that when the indication or timing gear has rotated through a predetermined angle, the protrusion **7*a* presses the top 10*a* of a trip lever 10 into pivotal motion, with the result that the lower end of the trip lever 10 is disengaged from a later described cam or contact actuating member 20. The trip lever 10 is adapted to pivot about a central pivot point and, as will be described, its lower end normally engages an engaging means 20d provided at a portion of the contact actuating member 20 so as to prevent the contact actuating member or cam 20 from being actuated. The actuation of the contact actuating member 20 is allowed when the trip lever 10 is pivoted to disengage its lower end from engaging portion 20d**.

The clutch mechanism 6 has an upper gear 61 and a lower gear 62 provided with intermeshing teeth **61*a* and 62*a* formed on opposed surfaces of the upper and lower gears 61 and 62 respectively. An operation shaft 61b fixed on the upper gear 61 is loosely passed through the lower gear 62 to project downwardly through a hole in the lower support plate 4. The top of the operation shaft 61*b*, on the other hand, is supported by a support member 3*a* formed by a partially bent portion of the upper support plate 3 and, at the same time, is maintained pressed down by a spring plate 11 placed opposedly thereto. The upper gear 61 mesh engages the indication or timing gear 7 and the lower gear 62 is coupled with a drive gear 8*a* of the drive motor 8 through the reduction gear 5 (represented by a single gear in the drawing), so that the rotation of the drive gear 8*a* is transmitted to the indication gear 7 through the reduction gear 5 and the clutch mechanism 6 as long as the teeth 61*a* are intermeshed with the teeth 62*a* of the lower gear 62 by the pressure applied to the upper gear 61 from the spring plate 11**.

Reference symbol B identifies an electromagnetic device block comprising an electromagnetic coil 13 and a fixed iron core 14 disposed inside of a yoke 12 substantially in the shape of a rectangular channel. Reference numeral 15 is an armature having its base end portion rotatably supported on one of the side plates of the yoke 12. Counterclockwise turning bias is supplied normally to the armature 15 by a tension spring 16 hung between the base end portion of the armature 15 and the fastening point **12*a* of the yoke 12**.

The channel shaped yoke 12 has its top bent horizontally to form fastening portions **12*b* and 12*c* adapted to be secured to the lower support plate 4** of the timing operation gear mechanism block A with screws or like fastening means, thus coupling the electromagnetic device block B to the timing operation gear mechanism block A.

The right and left side plates **12*d* and 12*e* of the yoke 12, when coupled with the timing operation mechanism block A, are situated inwardly of the horizontal ends of the mechanism block A, so that the tension spring 16** as well as the contact mechanism C (which will be later described) is contained within the width of the timing operation gear mechanism block A.

Reference symbol C identifies the contact mechanism block comprising a support frame 17, a pin 18 disposed crosswise on the top of the support frame 17, an instantaneous operation member or cam 19 for closing or opening contacts instantaneously, a timing operation member or cam 20 for timely closing or opening of contacts, tension springs 21 and 22 for applying counterclockwise turning bias to the operation members or cams 19 and 20 respectively, and a leaf spring contact assembly 23 adapted to be opened and actuated to selectively close and open the contacts thereof by the operation members 19 and 20 respectively. The support frame 17 has a back plate 17*a* at both ends of which upright side plates 17*b* and 17*c* are provided, and the pin 18 for supporting the operation members or cams is mounted therebetween. The back plate 17*a* is provided also with partitions 17*d* and 17*e* in parallel with the side plates 17*b* and 17*c* for isolating the instantaneous operation contacts, timing operation contacts and motor contacts which will be described later. Further, the back plate 17*a* is provided on the top thereof with an engaging groove 17*f* having a channel-shaped section, which engaging section 17*f* is adapted to engage a notch formed on a part of the yoke 12 making up a part of the electromagnetic device block B. Reference numeral 17*g* is a through hole for fastening a fixing means or screw, and 17*h* is a window hole.

The leaf spring contact assembly 23 comprises a first movable contact assembly 231 including movable contact plates 231*b* and 231*d* with their bases molded to an insulating body 231*a;* a second movable contact assembly 232 comprising movable contact plates 232*b*, 232*c* and 232*d* with their bases molded to an insulating body 232*a;* and a fixed contact assembly 233 including fixed contact plates 233*b*, 233*c* and 233*d* with their bases molded to an insulating body 233*a*. The first movable contact assembly 231, the fixed contact assembly 233 and the second movable contact assembly 232 are attached to each other in that order. The insulating bodies 231*a*, 233*a* and 232*a* are secured to the back plate 17*a* of the support frame 17 by means of a pair of fastening members 234 each comprising a substantially U-shaped spring plate bent horizontally.

The operation members 19 and 20 which are rotatably mounted on the pin 18 have substantially inversely L-shaped sides and are supported on the pin 18 at their corners. The horizontal portion 19*a* of the instantaneous operation member or cam 19 is projected through the window hole 17*h* provided at the top of the back plate 17*a* of the support frame 17 and further, when the support frame 17 is mounted on the yoke 12 of the electromagnetic device block B, the horizontal portion 19*a* is projected into the electromagnetic device block B, so that the lower surface of the horizontal portion 19*a* is opposed to a contact piece 15*a* provided at the tip of the armature 15, while the upper surface of the horizontal portion 19*a* is opposed to the lower end of the operation shaft 61*b* of the clutch mechanism 6 making up a part of the timing mechanism block A.

Since the force of the tension spring 21 is weaker than that of the tension spring 16, the instantaneous operation member or cam 19, in the de-energized state of the electromagnetic device block B, is turned clockwise by the force applied thereto through the armature 15 overcoming the force of the spring 21 which applies counterclockwise turning bias to the cam 19. As a result, the horizontal portion 19*a* causes the operation shaft 61*b* of the clutch mechanism 6 to be pushed upward, so that the teeth 61*a* of the upper gear 61 of the clutch mechanism 6 is disengaged from the teeth 62*a* of the lower gear 62 thereof, thus de-actuating the clutch mechanism 6. Of course, the rotation of the cam 19 is limited within a predetermined angular range by means of a stopper (not shown) disposed at an appropriate position.

The vertical portion 19*b* of the instantaneous operation member or cam 19 has a pair of extensions 19*c* and 19*d* on both sides of its lower end, which extensions 19*c* and 19*d* are positioned between the upper ends of the movable contact plates 231*b* and 232*b* of the leaf-spring contact assembly 23, so that when the cam 19 is in its normal state the extension 19*c* pushes the movable contact plate 231*b* outward to thereby open the contact between the movable contact plate 231*b* and the fixed contact plate 233*b* and the extension 19*d* allows the movable contact plate 232*b* to move inward to thereby close the contact between the movable contact plate 232*b* and the fixed contact plate 233*b*, and vice versa when the operating member or cam 19 is actuated to rotate counterclockwise.

The movable contact plates 231*b* and 232*b* and the fixed contact plate 233*b* constitute the instantaneous contact means. Tension spring 21 is supported between the horizontal portion 19*a* of an instantaneous operation member or cam 19 and the engaging portion 17*i* which protrudes from the back plate 17*a* of the support frame 17 for normally imparting the counterclockwise turning bias to the operation member or cam 19.

The timing operation member or cam 20 and the instantaneous opeation member or cam 19 are rotatably supported by the pin 18 of the support frame 17. The horizontal portion 20*a*, like the horizontal portion 19*a* of the instantaneous operating or cam 19, is projected from the window hole 17*h* of the back plate 17*a* of the support frame 17 into the electromagnetic device block B. Thus the contact piece 15*a* provided at the tip of the armature 15 of the electromagnetic device block B is opposed to the lower surface of the horizontal portion 20*a*, so that the counterclockwise rotation of the armature 15 in the de-energized state of the electromagnetic device block B causes the horizontal portion 20*a* to be pushed upward by the contact piece 15*a* thereby rotating the operation member or cam 20 in the clockwise direction. In order to assure this operation, the spring 22, like the spring 21, is weaker than the spring 16.

The timing operation member or cam 20 has a pair of vertical portions 20*b* and 20*c* arranged axially thereof. The vertical portion 20*b* is inserted between the respective upper ends of the movable contact plates 231*d* and 232*d* of the leaf-spring contact assembly 23, so that when the operation member or cam 20 is in its normal position the clockwise rotation of the operation member or cam contact between the movable contact plate 231*d* and the fixed contact plate 233*d* is maintained open and, at the same time, the contact between the movable contact plate 232*d* and the fixed contact plate 233*d* is closed, and vice versa when the operation member or cam 20 is allowed to rotate counterclockwise. The vertical portion 20*c*, on the other hand, has one of its sides in contact with movable contact plate 232*c* of the leaf-spring contact assembly 23 in such a manner that when the operation member or cam 20 is in its normal position the contact between the movable contact plate 232*c* and the fixed contact plate 233*c* is maintained in the closed state, and vice versa when the operation member or cam 20 is allowed to rotate counterclockwise.

Further, the operation member 20 has an engaging portion 20*d* on its side opposite to the horizontal portion 20*a*, which engaging portion 20*d* is engaged with the lower end portion of the trip lever 10 already described with reference to the timing operation gear mechanism block A thereby to normally limit the counterclockwise turning bias applied to the operation member or cam 20 by the tension spring 22. When the indication or timing gear 7 making up a part of the timing operation gear mechanism block A is rotated through a predetermined angle to cause the protrusion 7*a* formed on the top of the indication or timing gear 7 push the top 10*a* of the trip lever 10, the lower end portion of the trip lever 10 is disengaged from the engaging portion 20*d* of the timing operation member or cam 20, thereby releasing the operation member or cam 20 to be freely rotated counterclockwise.

The movable contact plates 231*d* and 232*d* and the fixed contact plate 233*d* of the leaf-spring contact assembly 23 subjected to on-off operation by the timing operation member or cam 20 constitute a timing contact means, while the movable contact plate 232*c* and the fixed contact plate 233*c* constitute the input contact section for the drive motor 8 of the timing operation gear mechanism block A.

The thus arranged contact mechanism block C has the leaf-spring contact assembly 23 secured in advance to the support frame 17 by means of the fastening members. Also, the instantaneous and timing operation members or cams 19 and 20 are rotatably supported at the top of the support frame 17 by means of the pin 18. After the engaging groove 17*f* on the top of the support frame 17 is engaged with the notch formed on a part of the yoke 12 of the electromagnetic device block B, the contact mechanism block C is mounted on one side of the yoke 12 by means of the screw 24.

Of course, for certain reasons in the fabricating steps, the support frame 17 and the leaf-spring contact assembly 23 are simultaneouslly attached together to the yoke 12 of the electromagnetic device block B by means of the screw 24, without previously attaching the leaf-spring contact assembly 23 to the support frame 17 by means of fastening members 234.

The operation of the motor timer according to the present invention will be now described hereinafter.

Upon the application of an exciting signal to the electromagnetic coil 13 of the electromagnetic device block B, the electromagnetic device block B is energized thereby to attract the armature 15 toward the fixed core 14. The instantaneous operation member or cam 19 which has thus far been prevented from being rotated counterclockwise by the contact piece 15a secured to the top of the armature 15 is set free and caused to rotate counterclockwise by means of the tension spring 21, with the result that the vertical portion 19*b* of the instantaneous operation member or cam 19 opens the contact between the movable contact plate 232*b* and the fixed contact plate 233*b* and allows the contact between the movable contact plate 231*b* and the fixed contact plate 233*b* to be closed, thereby producing an instantaneous signal. Thus, these contacts 231*b*, 232*b* and 233*b* constitute the instantaneous contact means of the leaf-spring contact assembly 23.

At the same 2 the operation shaft 61*b* making up a part of the clutch mechanism 6 of the timing operation gear mechanism block A which has thus far been lifted upward by the horizontal portion 19*a* of the operation member or cam 19 is set free, whereupon the spring plate 11 opposed to the top of the operation shaft 61*b* causes the operation shaft 61*b* to be pushed downward. Accordingly the upper gear 61 of the clutch mechanism 6 is pushed down and the teeth 61*a* are caused to engage the teeth 62*a* of the lower gear 62, thereby actuating the clutch mechanism 6.

The horizontal portion 20*a* of the timing operation member or cam 20 of the contact mechanism block C which has thus far been pushed up by the contact piece 15*a* of the armature 15 in the same manner as the instantaneous operation member or cam 19, is set free by the downward attraction of the armature 15. under this condition, however, the operation member or cam 20 is still prevented from counterclockwise rotation by the lower end portion of the trip lever 10 which still engages the engaging portion 20*d*.

On the other hand, the contact between the movable contact plate 232*c* and fixed contact plate 233*c* forming the input contact section for the drive motor 8 of the leaf-spring contact assembly 23 is still maintained at this time in the closed state by the vertical portion 20*c* of the timing operation member or cam 20, and therefore the drive motor 8 is started simultaneously with the excitation of the electromagnetic device, so that the rotation of the drive motor is transmitted to the indication or timing gear 7 through the drive gear 8*a*, the reduction gear 5 (only part of which is shown), and the clutch device 6.

After rotation of the indication or timing gear 7 through a predetermined angle, that is, with the lapse of a predetermined timing period, the protrusion 7*a* formed on the top of the indication or timing gear 7 pushes against the top 10*a* of the trip lever 10 and thus causes the trip lever 10 to rotate about its central supporting point. As a result of the rotation of the trip lever 10, the engaging portion 20*d* of the timing operation member or cam 20 is disengaged, so that the timing operation member or cam 20 is set free for counterclockwise motion by means of the tension spring 22. The counterclockwise rotation of the vertical section 20*b* of the timing operation member or cam 20 opens the contact between the movable contact plate 232*d* and the fixed contact plate 233*d* and allows the contact between the movable contact plate 231*d* and the fixed contact plate 233*d* to be closed thereby producing a timing signal. Thus, these contacts 231*d*, 232*d* and 233*d* constitute the timing contact means of the leaf-spring contact assembly 23.

At the same time as the generation of the timing signal, the vertical portion 20*c* of the timing operation member or cam 20 opens the contact between the fixed contact plate 233*c* and the movable contact plate 232*c* which constitute the input contact for the drive motor 8, thus stopping the rotation of the motor 8.

It will be obvious that as a result of the de-energization of the electromagnetic device block B the operation shaft 61*b* of the clutch 6, the instantaneous operation member or cam 19, and the timing operation member or cam 20 are pushed upward by means of the contact piece 15*a* of the armature 15 into their original or normal positions.

As mentioned above, the present invention is characterized in that the component elements of the motor timer are divided into three blocks including the timing operation gear mechanism block A having gears and the drive motor 8; the electromagnetic device block B; and the contact mechanism block C having the leaf-spring contact assembly 23 and the operation members or cams 19 and 20 for performing on-off operation of the leaf-spring contact assembly 23. These prefabricated blocks A, B and C are appropriately coupled and assembled in the final manufacturing process. In this way, the assembly work is greatly facilitated on one hand and an improved quality control or stock control results from the fact that the blocks A, B and C may be prefabricated separately in different shops on the other hand.

Another advantage of the invention lies in the manner of the arrangement of the blocks in which the electromagnetic block B placed side by side with the contact mechanism block C is positioned on the underside of the timing mechanism block A, thus makinga compact timer by the efficient utilization of available space. making a addition, the contact devices are concentrated, thus making the wiring job easy. Furthermore, by replacing a specific block, it is possible to change the characteristics of the timer. Moreover, in the case of any failure of a block, only that particular block may be removed for repair work, resulting in great practical advantage.

Further, the fact that the direction of operation of the contact means is substantially perpendicular to that of the armature of the electromagnetic device prevents any shock caused by the attraction or repulsion of the armature of the electromagnetic device from adversely affecting the operation of the contact means.

What is claimed is:

1. A motor timer comprising:

a prefabricated timing gear mechanism block including a drive motor, reduction gear means coupled with said drive motor, a timing gear for performing a timing operation, and clutch means for selectively connecting and disconnecting said reduction gear means to and from said timing gear;

a prefabricated electromagnetic means block disposed on the underside of said gear mechanism block and including a substantially channel-shaped yoke, electromagnetic coil means mounted in said yoke, and armature means adapted to be actuated in response to the energization of said electomagnetic coil means;

a prefabricated contact mechanism block including a spring contact assembly having first and second contact groups, first cam means releasably engaged with said armature means and adapted to effect the opening and closing operation for said first contact group as soon as said first cam means has been released from said engagement with said armature means in response to the actuation of said armature means, means for actuating said clutch means in response to the actuation of said first cam means, second cam means releasably engaged with said armature means for effecting the opening and closing operation for said second contact group, and means for operatively connecting said timing gear with said second cam means to allow said second cam means to effect the opening and closing operation for said second contact group after the lapse of a predetermined period of time following the releasing of said second cam means in response to the actuation of said armature means; and means for securing said gear mechanism block, said electromagnetic means block and said contact means block to one another.

2. A motor timer according to claim 1, in which the direction of operation of said first and second contact groups of said spring contact assembly is substantially perpendicular to that of said armature means.

3. A motor timer according to claim 2 in which said prefabricated contact mechanism block further includes a frame body including at least one partition for isolating said contact groups from each other, said spring contact assembly being mounted on the lower portion of said frame body, and a support pin mounted crosswise on the top of said frame body for rotatably supporting said first and second cam means.

4. A motor timer according to claim 2 in which said prefabricated contact mechanism block further includes a contact barrier construction comprising:

a frame body including side plates on both sides thereof and a back plate;

a mounting structure formed adjacent the lower end of said frame body for attaching thereto an insulating base comprising a portion of said spring contact assembly;

a pin disposed crosswise adjacent the top of said frame body and between said side plates for supporting said first and second cam means;

at least one partition provided on the back plate of said frame body for isolating said first and second contact groups of said spring contact assembly from each other; and an engaging portion comprising a mounting structure provided on the top of said frame body.

5. A motor timer according to claim 2 in which said prefabricated timing gear mechanism block further includes upper and lower parallel support plates, said drive motor being mounted on the underside of said lower support plate; said clutch means including upper and lower clutch gears respectively having engaging teeth on opposite surfaces thereof, said upper clutch gear being fixed on an operation shaft passing therethrough, said operation shaft being loosely passed through said lower clutch gear and projecting downwardly from said lower support plate, said operating shaft having its top end pressed downwardly by means of a spring plate and being supported on said armature means, said timing gear being in mesh with said upper clutch gear and having an upper shaft which projects through said upper support plate, and a timing operation indicator attached to the projecting portion of said upper shaft.

6. A motor timer comprising:

a timing mechanism block including a pair of support plates disposed in parallel to each other, reduction gear means supported between said support plates, a timing gear disposed between said support plates for performing a timing operation, clutch means supported between said support plates for selectively connecting and disconnecting said reduction gear means to and from said timing gear, a drive motor mounted on one of said support plates and coupled with said reduction gear means, and a clutch operation shaft for actuating said clutch means;

an electromagnetic means block disposed on the underside of said timing mechanism block; and a contact mechanism block disposed on one side of said electromagnetic means block and including a leaf-spring contact assembly having first and second contact groups, first and second operation members disposed on the top of said leaf-spring contact assembly for effecting the opening and closing operation for said first and second contact groups respectively, means for normally applying a turning bias in one direction to each of said first and second operation members to thereby cause said first and second operation members to effect the opening and closing operation for said first and second contact groups, respectively, when turning is allowed, and trip lever means adapted to be actuated in response to the timing operation of said timing gear, said first operation member having first engaging means releasably engaged with an armature means of said electromagnetic means block for limiting the rotation of said first operation member by said turning bias applies thereto and second engaging means adapted to be operatively engaged with said operation shaft of said clutch means so that the rotation of said first operation member is allowed when said first engaging means is released in response to the energization of said electromagnetic block means and at the same time said second engaging means allows said operation shaft of said clutch means to be actuated to thereby bring said clutch means into its actuated state, said second operation member having third and fourth engaging means releasably engaged with said armature means and said trip lever means respectively so that said trip lever means causes said fourth engaging means to be released from the engagement with said trip lever means in response to the timing operation of said timing gear after the lapse of a predetermined period of time following the releasing of said third engaging menas from the engagement with said armature means upon the energization of said electromagnetic means block, thereby allowing the rotation of said second operation member by said turning bias applied thereto.

7. A motor timer according to claim 4, in which said first and second operation members have horizontal portions forming said first and third engaging means respectively, and also vertical portions for effecting the opening and closing operation for said first and second contact groups respectively.

8. A motor timer according to claim 4, in which said first and second operating members are rotatably supported adjacently to each other on a support shaft located crosswise on the top of said leaf-spring contact assembly.

9. A motor timer according to claim 4 in which said contact mechanism block further includes a frame body including at least one partition for isolating said contact groups from each other, said leaf-spring contact assembly being mounted on the lower portion of said frame body, and a support pin mounted crosswise on the top of said frame body for rotatably supporting said first and second operation members.

10. A motor timer according to claim 4 in which said contact mechanism block further includes a contact barrier construction comprising:

a frame body including a pair of opposed side plates and a back plate therebetween;

a mount formed adjacent the lower end portion of said frame body for attaching thereto an insulating base of said leaf-spring contact assembly;

a pin disposed crossswise adjacent the top of said frame body and between said side plates for supporting said first and second operation members;

a least one partition provided on the back plate of said frame body for isolating said first and second contact groups of said leaf-spring contact assembly from each other; and an engaging portion comprising a mount provided on the top of said frame body.

11. A motor timer according to claim 4 in which said clutch means includes a pair of clutch gears respectively having engaging teeth on opposite surfaces thereof, one of said clutch gears being fixed on said clutch operation shaft, said clutch operation shaft passing loosely through the other of said clutch gears and projecting outwardly from one of said support plates, said operation shaft being urged toward said other clutch gear by spring means in engagement therewith and being supported on said armature means, said reduction gear means connecting the shaft of said motor to said other clutch gear, said timing gear being in mesh engagement with said one of said clutch gears and having an indicator shaft which projects through the other one of said support plates, said indicator shaft being provided at its free end with a timing operation indicator.

12. A motor timer comprising:

a timing mechanism section including a drive motor, a reduction gear device coupled with said drive motor, a timing gear for performing a timing operation, and a clutch device for selectively connecting and disconnecting said reduction gear device to and from said timing gear, said clutch device comprising a pair of upper and lower gears having respectively engaging tooth sections on their opposite surfaces, said clutch device further having an operation shaft secured to one of said upper and lower gears;

an electromagnetic device disposed on the underside of said timing mechanism section; and a contact mechanism disposed on one side of said electromagnetic device and including a leaf-spring contact assembly having an instantaneously operated contact group and a timing operated contact group, and an instantaneous operation member and a timing operation member both supported rotatably on the top of said leaf-spring contact assembly for effecting the opening and closing operation for said instantaneously operated contact group and said timing operated contact group respectively, said instantaneous operation member being susbstantially inversely L-shaped and having a horizontal portion the upper surface of which is in contact with the lower end portion of said operation shaft, said operation shaft being set in vertical motion in response to the actuation of said instantaneous operation member thereby to perform the connection between said upper and lower gears of said clutch device.

13. A motor timer according to claim 10 in which said contact mechanism further includes a frame body including at least one partition for isolating said contact groups from each other, said leaf-spring contact assembly being mounted on the lower portion of said frame body, and a support pin mounted crosswise on the top of said frame body for rotatably supporting said instantaneous operation and timing operation members.

14. A motor timer according to claim 10 in which said contact mechanism further includes a contact barrier construction comprising:

a frame body including side plates on both sides thereof and a back plate;

a mount formed on the lower end portion of said frame body for attaching thereto an insulating base of said leaf-spring contact assembly;

a pin disposed crosswise on the top of said frame body and between said plates for supporting said instantaneous operation and timing operation members;

at least one partition provided on the back plate of said frame body for isolating said contact groups of said leaf-spring contact assembly from each other; and an engaging portion comprising a mount provided on the top of said frame body.

15. A motor timer according to claim 10 in which said timing mechanism section further includes upper and lower parallel support plates, said motor being mounted on the underside of said lower support plate, said operation shaft being secured to said upper clutch gear and passing therethrough, said operation shaft being loosely passed through said lower clutch gear and projecting downwardly from said lower support plate, said operation shaft being pressed down by spring means and being supported on an armature of said electromagnetic device, said timing gear being in mesh engagement with said upper clutch gear and having an upper shaft which projects through said upper support plate, said upper shaft being provided at its free end with a timing operation indicator.

* * * * *